US005108304A

United States Patent [19]

Bogiel et al.

[11] Patent Number: 5,108,304

[45] Date of Patent: Apr. 28, 1992

[54] HERMAPHRODITIC TERMINAL

[75] Inventors: Steven B. Bogiel, Schaumburg; Mark M. Data, Bolingbrook; Robert W. DeRoss, Naperville; Timothy R. McClelland, Bolingbrook; David M. Skowronski, Naperville, all of Ill.

[73] Assignee: Molex Incorporated, Lisle, Ill.

[21] Appl. No.: 667,789

[22] Filed: Mar. 11, 1991

[51] Int. Cl.[5] ..... H01R 25/00

[52] U.S. Cl. ..... 439/290; 439/287; 439/291; 439/851; 439/856

[58] Field of Search ..... 439/287-291, 439/834, 850-852, 856, 862

[56] References Cited

U.S. PATENT DOCUMENTS

| | | | |
|---|---|---|---|
| 2,434,226 | 1/1948 | Reynolds | 439/290 |
| 3,011,143 | 11/1961 | Dean | 439/291 |
| 3,516,043 | 6/1970 | Spofford | 439/287 |
| 3,634,811 | 1/1972 | Teagno et al. | 439/290 |
| 3,789,343 | 1/1974 | Hirokawa et al. | 439/291 |

*Primary Examiner*—Paula A. Bradley

*Attorney, Agent, or Firm*—Stephen Z. Weiss; Charles S. Cohen

[57] ABSTRACT

An electrical terminal structure is provided by a pair of hermaphroditic terminals. In one form of the invention, each terminal is bifurcated to define a pair of elongated semi-cylindrical arms of different diameters defining pairs of elongated spaced edges to provide a four-point contact array. In another form of the invention, a pair of hermaphroditic terminals each are trifurcated to define a central semi-cylindrical arm and two outside arms, combining to provide a six-point contact array.

5 Claims, 2 Drawing Sheets

HERMAPHRODITIC TERMINAL

FIELD OF THE INVENTION

This invention generally relates to the art of electrical connectors and, particularly, to a hermaphroditic terminal for use in electrical connectors.

BACKGROUND OF THE INVENTION

In some environments, electrical connectors must be disconnected and reconnected frequently by field personnel in relatively uncontrolled situations. One example is in the field of computers and similar equipment. Such electrical connectors should be designed to minimize the possibility of damage from any misalignment of the terminals that may occur. Usually, where repeated disconnections and reconnections are anticipated, the terminals of such connectors are designed to have relatively low insertion forces, again to prevent damage to the terminals due to the frequent disconnect and reconnect usage.

One of the most common configurations of terminals for use with electrical connectors of the character described above is the configuration of terminal studs or pins which are inserted into hollow terminal cylinders or sockets. One of the problems with pin and socket terminal configurations is that there really is no defined points of contact and the terminals begin to loosen in such repeated disconnect/reconnect environments. In addition, when such terminal configurations are used in apparatus which require a considerable number of terminal connections of different sizes, it can be understood that tooling costs and inventory management involve a factor of two because of the different structures of the mating terminals.

In order to solve the problems described above with conventional pin and socket terminal configurations, hermaphroditic terminals have been designed such that two identical terminals and/or their housings are mateable with one another. Hermaphroditically constructed terminals and housings substantially reduce tooling costs and factory inventory. In addition, many hermaphroditic terminals can be designed with positive points of contact versus the telescoping contact configuration of a pin in a hollow socket. However, in designing hermaphroditic terminals, there is a tendency to design the terminals with rather complicated configurations. This particularly is true when it is desirable to design the contact with a plurality of positively engageable points of contact between the two identical terminals. This invention is directed to providing a hermaphroditic terminal which is extremely simple to manufacture and which provides up to four or six elongated points of positive contact between the terminals.

SUMMARY OF THE INVENTION

An object, therefore, of the invention is to provide a new and improved hermaphroditic terminal for use in a mating electrical terminal structure.

In one form of the invention, the hermaphroditic terminal is bifurcated to define a pair of elongated arms. Each arm has a pair of elongated spaced edges facing the other arm. One of the arms is larger in cross-sectional dimensions than the other arm to locate the elongated edges of the one arm outside the elongated edges of the other arm. Therefore, when the terminals are mated, a four-point elongated contact array is provided between the pairs of elongated edges of the larger dimensioned arms of the respective mated terminals and between the pairs of elongated edges of the smaller dimensioned arms of the respective mated terminals.

The hermaphroditic terminal construction described immediately above is extremely simple to manufacture as a unitary stamped and formed metal component having either a generally rectangular or semicircular cross section. In the preferred embodiment, the mating portion of each terminal is generally cylindrical whereby each arm of each terminal is generally semi-cylindrical, the one arm of each terminal being of a larger radius than the other arm to locate the elongated edges along the semi-cylindrical configurations in a four-point contact array as described above.

In another form of the invention, the electrical terminal structure includes a pair of hermaphroditic terminals which are trifurcated to define three elongated arms for each terminal. The arms include a central arm and two outside arms. The central arm has a pair of elongated spaced edges facing in one direction. The outside arms have elongate contact portions in transverse registry with and spaced from the elongated edges of the central arm. Each outside arm has an elongated edge facing in a direction opposite the direction of the elongated spaced edges of the central arm. Therefore, when the terminals are mated, a six-point elongated contact array is provided between the pairs of elongated edges of the central arms and the elongated contact portions of the outside arms of the respective mated terminals and between the elongated edges of the outside arms of the respective mated terminals.

Again, the six-point contact terminal is very simply fabricated of stamped and formed metal material, with the central arm of each hermaphroditic terminal being generally semi-cylindrical. Each outside arm is generally planar to define the contact portion thereof, with the elongated edge thereof being defined by an inwardly turned edge of the planar contact portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
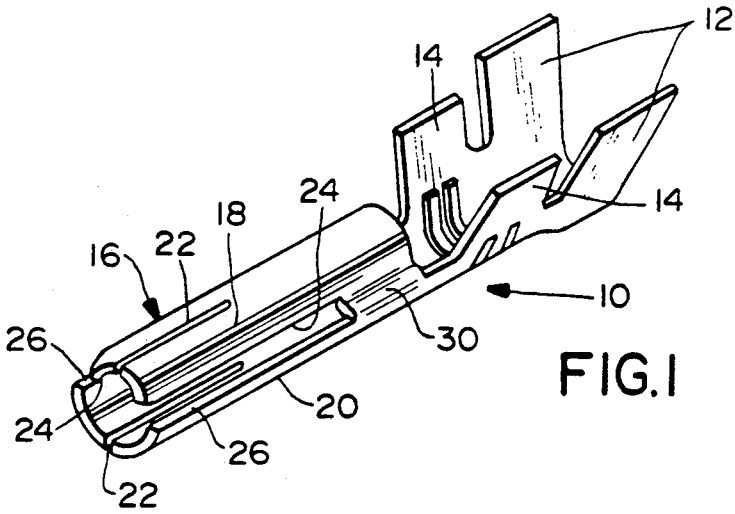
FIG. 1 is a perspective view of one form of hermaphroditic terminal according to the invention.
Figure 2:
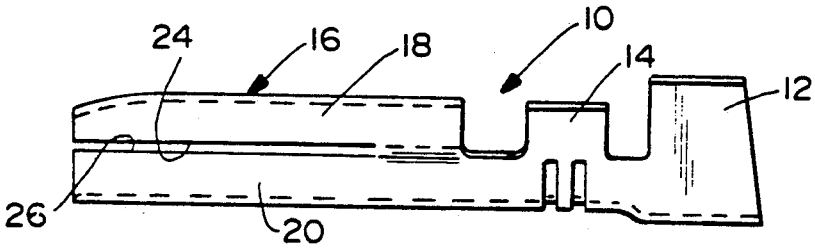
FIG. 2 is a side elevational view of the terminal of FIG. 1.

Referring to the drawings in greater detail and first to FIGS. 1 and 2, one form of hermaphroditic terminal according to the invention is shown and generally designated 10. Each terminal includes a rear crimping portion including two pairs of crimp arms 12 and 14. As is well known in the art, crimp arms 12 are provided for clamping onto an insulating jacket of an insulated wire to provide strain relief thereon. Crimp arms 14 are provided for clamping onto an exposed length of a conductive core of the insulated wire, stripped of the insulating jacket, to terminate the conductor to the terminal.

The invention contemplates that terminal 10 be provided with a bifurcated mating portion, generally designated 16, at its forward end. The bifurcated mating portion is generally cylindrical and includes a pair of elongated arms 18 and 20 which are generally semi-cylindrical. Each arm 18 and 20 is provided with an elongated slot 22 to provide resiliency therefor. The terminal is easily stamped and formed as a unitary component from sheet metal material. Therefore, each semi-cylindrical arm 18 and 20 of cylindrical bifurcated mating portion 16 is provided with a pair of elongated spaced edges 24 and 26, respectively, facing the other arm.

The invention contemplates that one of semi-cylindrical arms 18,20 be of a larger cross-sectional dimension or diameter than the other arm. Generally, this differential dimensioning locates the elongated edges of the larger diameter arm outside the elongated edges of the other arm. With this configuration, it can be seen in FIG. 3 how two hermaphroditic terminals 10 easily can be mated by interengagement of their bifurcated mating portions 16. To assist in mating, each cylindrical arm 18 has an inclined leading surface at its forward mating end.

Figure 4:
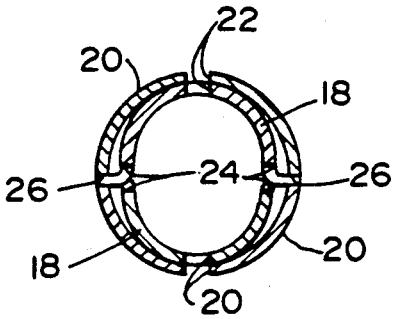
FIG. 4 is a vertical section taken generally along line 4—4 of FIG. 3.

As seen in FIGS. 1 and 4, arm 20 is of a larger diameter than arm 18. In a stamping and forming process, a web 30 interconnects arm 18 with arm 20 and offsets the smaller diameter arm 18 inside of and concentric with larger diameter arm 20. With the terminal being stamped and formed as a unitary component, the left-hand edges 24 and 26 of arms 18 and 20, respectively, extend all the way through mating portion 16.

Figure 3:
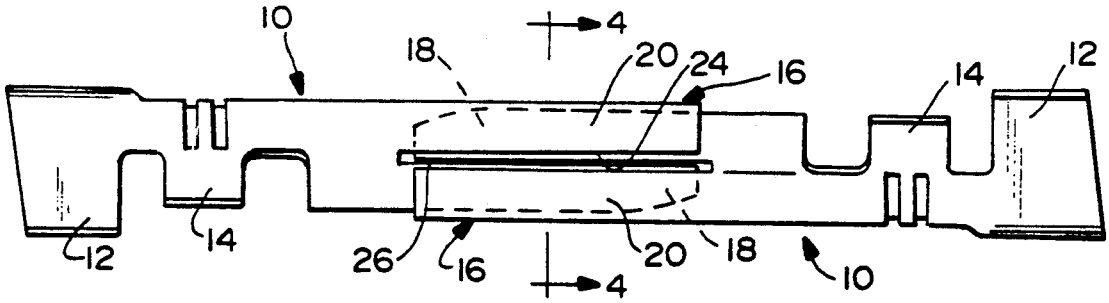
FIG. 3 is a side elevational view of two of the terminals of FIGS. 1 and 2, in mated condition.

With the above-described structure of hermaphroditic terminal 10, and with two terminals 10 mated as shown in FIG. 3, a positive four-point elongated contact array is provided between the mating terminals. This array is illustrated in FIG. 4 wherein it can be seen that the outside or larger diameter arm 20 of each mated terminal is disposed outside the inner or smaller diameter arm 18 of the other terminal. Opposing edges 24 of the two inner or smaller diameter arms of the two mated terminals define two positive points of contact, and the opposing edges 26 of the two outside or larger diameter arms of the two terminals define two additional positive points of contact. Although some spacing between the opposing edges 24 and 26 might be present in FIG. 4 to facilitate the illustration, it is contemplated that the hermaphroditic terminals be stamped and formed so that there are resilient forces between the arms biasing the respective opposing edges against each other to provide the positive four-point contact array.

Figure 5:
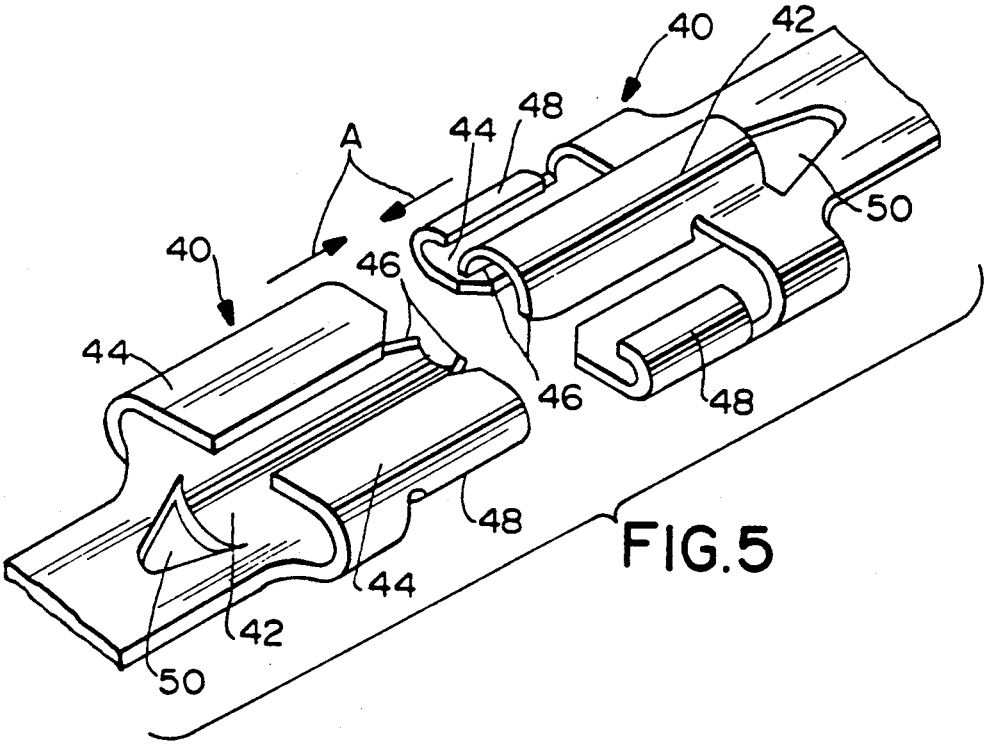
FIG. 5 is a perspective view of a pair of hermaphroditic terminals of a second form of the invention, about to be mated.

FIG. 5 shows another form of the invention wherein a hermaphroditic terminal, generally designated 40, provides a six-point elongated contact array with an identical mated terminal. Two identical terminals are shown in FIG. 5, reversed 180° in orientation for mating in the direction of arrows A. Each terminal 40 will have some form of means for termination to an electrical wire, such as crimp arms 12 and 14 (FIG. 1) for terminating the core of an insulated wire and providing strain relief thereon.

More particularly, each terminal 40 is stamped and formed generally to have a trifurcated configuration defining three elongated arms, including a central arm 42 and two outside arms 44. Central arm 42 is generally semi-cylindrical to define a pair of elongated spaced edges 46 with a taper at the forward leading portion of both edges. Outside arms 44 are generally planar and include inwardly turned flanges which define two edges or points of contact 48. The edges of arms 44 which face each other have a chamfer formed at its leading edge which assists in the mating of arms 44 with central arm 42. Again, hermaphroditic terminal 40 is easily stamped and formed from sheet metal material. Aperture 50 is provided to relieve stress in the metal during the forming process of the terminal.

As viewed in FIG. 5, the terminal is formed such that edges 46 of the right-hand terminal 40 will engage the top of planar arms 44 of the left-hand terminal, as viewed in FIG. 5. Therefore, two elongated points of contact are formed between each semi-cylindrical arm 42 of each terminal with the planar arms 44 of the other terminal, resulting in four additional elongated points of contact between the mated terminals.

Figure 6:
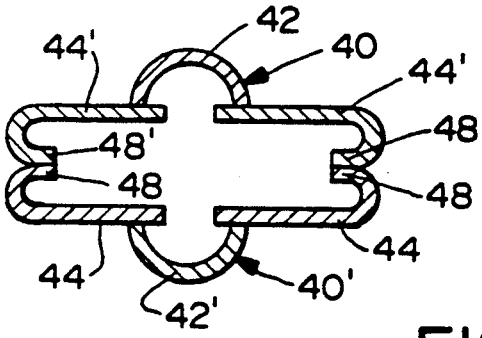
FIG. 6 is a vertical section through a pair of terminals as shown in FIG. 5, when in mated condition.

These six elongated points of contact are illustrated in FIG. 6. In this figure, even though the terminals are identical, reference numerals having the "prime" notation are applied to the arms and edges of one of the identical terminals in order to facilitate the illustration. More particularly, central arm 42 of one terminal is shown to have its elongated edges 46 in contact with the top of planar arms 44' of the mating terminal. Likewise, central arm 42' is shown to have its elongated edges 46' in contact with the bottoms of planar arms 44 of the opposite terminal. Therefore, four elongated points of contact are provided between the two edges of the two central arms and the two planar arms of the opposing terminals. Continuing, it can be seen that inwardly turned flanges 48 of terminal 40 and inwardly turned flanges 48' of terminal 40' are in biased engagement to provide two additional elongated points of contact, totalling a six-point contact array when two hermaphroditic terminals are mated. Again, with the terminals being stamped and formed of sheet metal material, the central arm and the outside arms of the terminal are located so that there is provided biasing forces between the various arms at the six points of contact to provide positive engagement between the various components, such as a press-fit with many electrical connector terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal structure, comprising a pair of hermaphroditic terminals, each terminal being bifurcated to define three elongated arms including a central arm and two outside arms, the central arm having a pair of elongated spaced edges facing in one direction, the outside arms having elongate contact portions in transverse registry with and spaced from the elongated edges of the central arm, and each outside arm having an elongated edge facing in a direction opposite said one direction whereby, when the terminals are mated, a six-point elongated contact array is provided between the pairs of elongated edges of the central arms and the elongated contact portions of the outside arms of the respective mated terminals and between the elongated edges of the outside arms of the respective mated terminals.

2. The electrical terminal structure of claim 1 wherein each terminal comprises a unitary stamped and formed metal component.

3. The electrical terminal structure of claim 1 wherein said central arm of each terminal is generally semi-cylindrical.

4. The electrical terminal structure of claim 1 wherein each said outside arm is generally planar defining said contact portion thereof and said elongated edge thereof is defined by an inwardly turned edge of the planar contact portion.

5. An electrical terminal structure unitarily fabricated of stamped and formed metal material, comprising a pair of hermaphroditic terminals, each terminal being trifurcated to define three elongated arms including a central arm and two outside arms, the central arm being generally semi-cylindrical and defining a pair of elongated spaced edges facing in one direction, the outside arms having a generally planar portion in transverse registry with and spaced from the elongated edges of the semi-cylindrical central arm, and each outside arm having an inwardly turned edge of the planar portion thereof facing in a direction opposite said one direction whereby, when the terminals are mated, a six-point contact array is provided between the pairs of elongated edges of the central arms and the planar portions of the outside arms of the respective mated terminals and between the inwardly turned edges of the outside arms of the respective mated terminals.

* * * * *